United States Patent [19]

Bartholomew et al.

[11] Patent Number: 4,716,831

[45] Date of Patent: Jan. 5, 1988

[54] DETONATING CORD CONNECTOR

[75] Inventors: Stephen W. Bartholomew, Granby, Conn.; Daniel C. Rontey, Lebanon, N.J.; William J. Necker, Collinsville, Conn.

[73] Assignee: The Ensign-Bickford Company, Simsbury, Conn.

[21] Appl. No.: 926,395

[22] Filed: Nov. 3, 1986

[51] Int. Cl.[4] ..... F42B 3/16; C06C 5/00

[52] U.S. Cl. ..... 102/275.3; 102/275.7

[58] Field of Search ..... 102/275.2–275.8, 102/275.12

[56] References Cited

U.S. PATENT DOCUMENTS

| | | | |
|---|---|---|---|
| 1,652,961 | 12/1927 | Snelling | 102/275.7 |
| 2,618,221 | 11/1952 | Lowe | 102/275.4 |
| 2,707,438 | 5/1955 | Mann et al. | 102/275.3 |
| 2,707,439 | 5/1955 | Hamilton | 102/275.3 |
| 2,736,263 | 2/1956 | Lewis et al. | 102/275.3 |
| 2,891,476 | 6/1959 | Forsyth | 102/275.3 |
| 3,343,487 | 9/1967 | Hare et al. | 102/275.3 |
| 3,727,552 | 4/1973 | Zakheim | 102/275.3 |
| 3,987,732 | 10/1976 | Spraggs et al. | 102/275.7 X |
| 3,987,733 | 10/1976 | Spraggs et al. | 102/275.4 |
| 4,248,152 | 2/1981 | Yunan | 102/275.4 |
| 4,424,747 | 6/1984 | Yunan | 102/275.2 |
| 4,481,884 | 11/1984 | Yunan | 102/275.3 X |

FOREIGN PATENT DOCUMENTS 726295 8/1953 United Kingdom .

*Primary Examiner*—David H. Brown

*Attorney, Agent, or Firm*—Hayes & Reinsmith

[57] ABSTRACT

A detonating cord signal delay connector having a housing; means on the housing for engaging a first detonating cord end and a second detonating cord end; a signal delay assembly in the housing for connection between the first detonating cord end and the second detonating cord end, the signal delay assembly being operable to delay a detonating signal between the detonating cord first and second ends; and gripping means for securing the detonating cord first and second ends in the housing to prevent removal of the ends before signal delay operation of the connector. The preferred embodiment of the connector further includes means on the housing for severing detonating cord to produce the detonating cord first and second ends. The preferred embodiment of the delay assembly comprises a signal transmission tube in the housing having a first end and a second end, the first transmission tube end being adapted for signal receiving connection with the first detonating cord end; and a delay explosive train mounted in the housing and having a signal input end, a signal output end, and a preselected combustion time between the signal input and output ends, the signal input end being connected to the signal transmission tube second end, the signal output end being adapted for connection with the second detonating cord end.

17 Claims, 4 Drawing Figures

DETONATING CORD CONNECTOR

BACKGROUND OF THE INVENTION

This invention relates to a signal delay connector for a blasting signal detonating cord.

In detonating a plurality of blasting charges it is often required that the timing of such detonations be controlled precisely. This is true, for example, in blasting quarries where sequential delays between charges must be controlled within milliseconds. In order to control such timing of charges, transmission lines are deployed from a central initiating point to send a signal to detonate the individual blasting charges. Normally, these lines consist of one or more main truck lines connected to a plurality of down lines.

Timing of the detonating signal is normally accomplished by using preselected lengths of known signal velocity transmission lines, and by utilizing signal delay units where necessary.

The manner of connection of the signal transmission lines, for example, between a trunk line and a plurality of down lines, depends on the type of transmission line utilized. Conventional destructing combustible fuses and detonating cords may be connected by tying together and knotting the line ends. In some cases supplementary charges are utilized to assure that the signal is transmitted. A supplementary charge device is as disclosed in U.S. Pat. No. 4,481,884. Where additional delay time is required, a delay unit may be tied between the ends of the combustible fuses or detonating cords, for example, as disclosed in U.S. Pat. No. 2,736,263.

It is often desired to insert a signal delay unit in an intermediate portion of a detonating cord between the cord ends. With prior art delay units, it is necessary to cut the detonating cord at the desired insertion point and then secure the ends, usually by tying, to a signal delay unit. This can be a time-consuming process. Problems may also develop with the amount of cord available for securing the cord ends to the delay unit. It is almost always difficult, or at least inconvenient, to cut the detonating cord itself because of the additional tools required.

Even if it is desired to secure a delay unit between already separate detonating cord ends, problems can arise with the reliability of the connections between the cord and the unit. Knots may be difficult to make in the detonating cord during field installation. Care must be taken to position the input and output detonating cords on either side of the signal delay unit so that they do not touch to prevent a signal from passing from the input cord directly to the output cord and bypassing the delay unit. Furthermore, restraints on detontaing cord coreload are often imposed to prevent "sympathetic" or instaneous initiation of the delay explosive train and the output cord.

Blasting operations almost always take place in outdoor or underground locations. All of the above stated problems are compounded where such activities take place under adverse environmetal circumstances such as in rain, snow or cold conditions.

It is therefore an object of the present invention to provide an improved means for connecting a signal delay unit to detonating cord which does not require tying or knotting.

It is another object of the present invention to provide a means for connecting a signal delay unit to detonating cord which has improved reliability.

It is a further object of the present invention to provide a means for connecting a signal delay unit to detonating cord which may be utilized under adverse environmental conditions.

It is another object of the present invention to provide a means for connecting a signal delay unit to a detonating cord at an intermediate portion thereof.

It is yet another object of the present invention to provide a means for connecting a signal delay unit to detonating cord which requires no additional tools.

It is a further object of the present invention to provide a means for connecting a signal delay unit to detonating cord which is inexpensive and essentially disposable.

Other objects will be in part obvious and in part pointed out in more detail hereinafter.

A better understanding of the objects, advantages, features, properties and relations of the invention will be obtained from the following detailed description and accompanying drawing which sets forth an illustrative embodiment and is indicative of the way in which the principle of the invention is employed.

SUMMARY OF THE INVENTION

The present invention comprises a detonating cord signal delay connector having a housing: means on the housing for engaging a first detonating cord end and a second detonating cord end; a signal delay assembly in the housing for connection between the first detonating cord end and the second detonating cord end, the signal delay assembly being operable to delay a detonating signal between the detonating cord first and second ends; and gripping means for securing the detonating cord first and second ends in the housing to prevent removal of the ends before signal delay operation of the connector. The preferred embodiment of the connector further includes means on the housing for severing detonating cord to produce the detonating cord first and second ends.

The preferred embodiment of the delay assembly comprises linear signal transmission means in the housing having a first end and a second end, the first transmission means end being adapted for signal receiving connection with the first detonating cord end; and a delay explosive train mounted in the housing and having a signal input end, a signal output end, and a preselected combustion time between the signal input and output ends, the signal input end being connected to the signal transmission means second end, the signal output end being adapted for connection with the second detonating cord end.

DETAILED DESCRIPTION OF THE INVENTION

The preferred embodiment of the detonating cord signal delay connector is shown in FIGS. 1, 2, 3 and 4. Like identifying numerals are used throughout the figures to identify like features.

Figure 1:
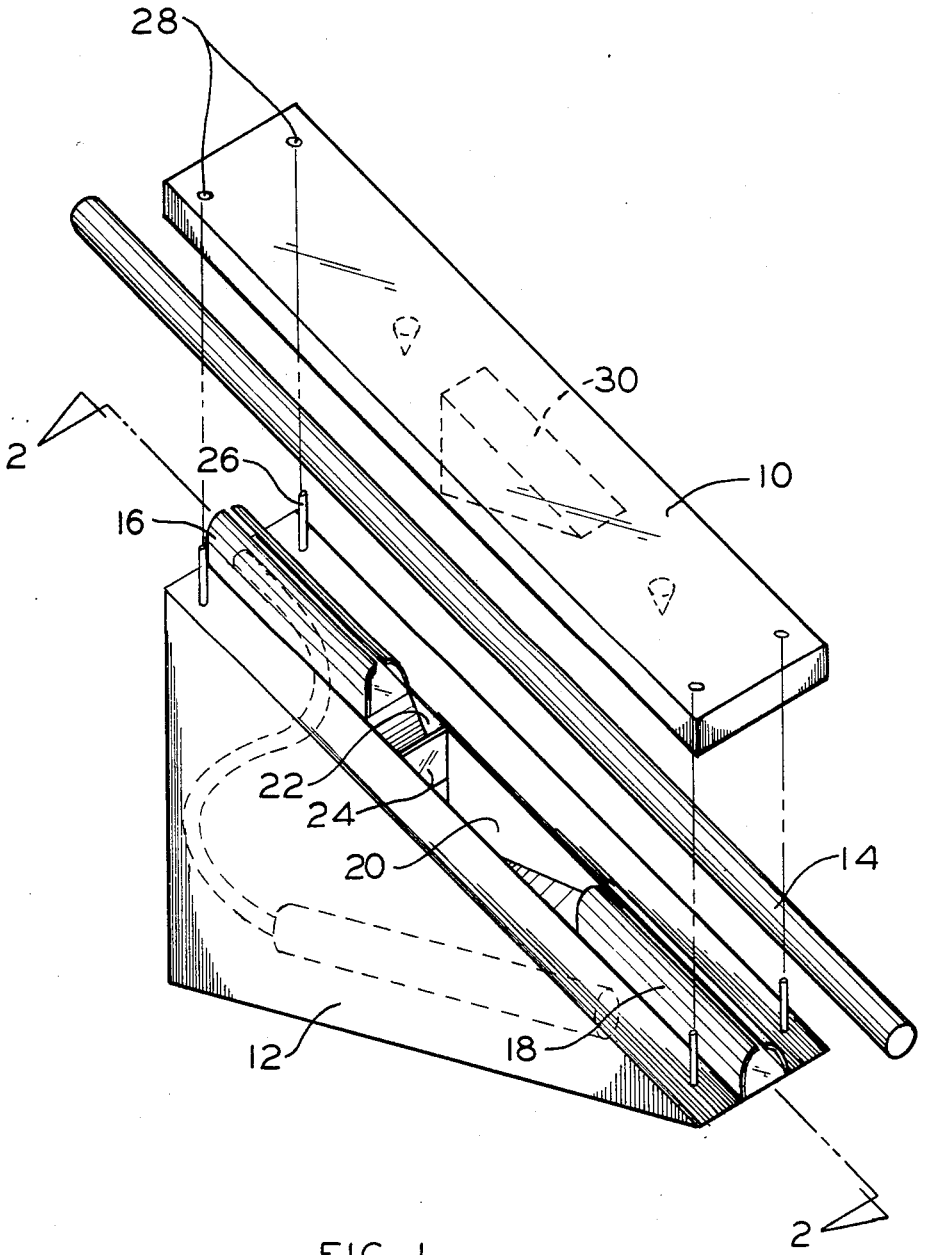
FIG. 1 is a partially exploded perspective view of the preferred embodiment of the detonating cord signal delay connector of the present invention.

In FIG. 1, the detonating cord connector is shown in a partially exploded view. The connector housing, preferably made of plastic, comprises an elongated upper and lower housing 10 and 12, respectively. Housing sections 10 and 12 are shown in an open and separated position to receive a length of detonating cord 14. The detonating cord length 14 shown herein may be an intermediate portion of a longer detonating cord length which runs, for example, between rows of individual blasting charges. The detonating cord 14 is received in the lower housing unit 12 along the major axis thereof. Clips 16 and 18 at opposite ends of housing sections 12 engage detonating cord 14. Clips 16 and 18 also secure the portions of detonating cord 14 which extend out of and away from the connector in opposite directions. This facilitates the positioning of detonating cord 14 so as to reduce the chance of the cord on one side of the connector from laying across the cord on the other side of the connector and causing a signal to bypass the connector.

Detonating cord 14 need not be a single length as shown here but may comprise two individual lengths whose ends are received and engaged in clips 16 and 18.

As seen in both FIGS. 1 and 2, lower housing section 12 contains a chamber having relieved areas 20 and 22 between cord clips 16 and 18 and below the path of detonating cord 14 when it is received in the cord clips. Between relieved areas 20 and 22 is severing or cutting means 24, which in this embodiment comprises a single straight razor blade aligned transversely to the direction of the detonating cord 14. The cutting edge of razor blade 24 is positioned below the path of detonating cord 14 when it is received in cord clips 16 and 18. Cutting means 24 is operable to sever a single length 14 of detonating cord, as shown, into two separate lengths.

Upper housing section 10 is adapted to fit over and connect to lower housing section 12 when detonating cord 14 is received within the cord clips 16 and 18. Complementary shaped guide posts 26 and holes 28 align the two housing sections 10 and 12 in their proper position during closing. A ramped shaped projection 30 extending from the lower side of upper housing section 10 is designed to mate with razor blade 24 and relieved sections 20 and 22 to urge the detonating cord 14 against razor blade 24 as housing section 10 and 12 are brought together and secured. Teeth 44 extending from the underside of housing section 10 grip the detonating cord 14 at the clipped areas to secure cord 14 within the connector housing to prevent the cord from being removed from the connector before operation. These gripping teeth provide for a simple, non-tied connection between the detonating cord and the connector which eliminates the necessity of knotting the cord during connection. Any suitable means such as clips (not shown) may be used to secure housing sections 10 and 12 together.

Figure 3:
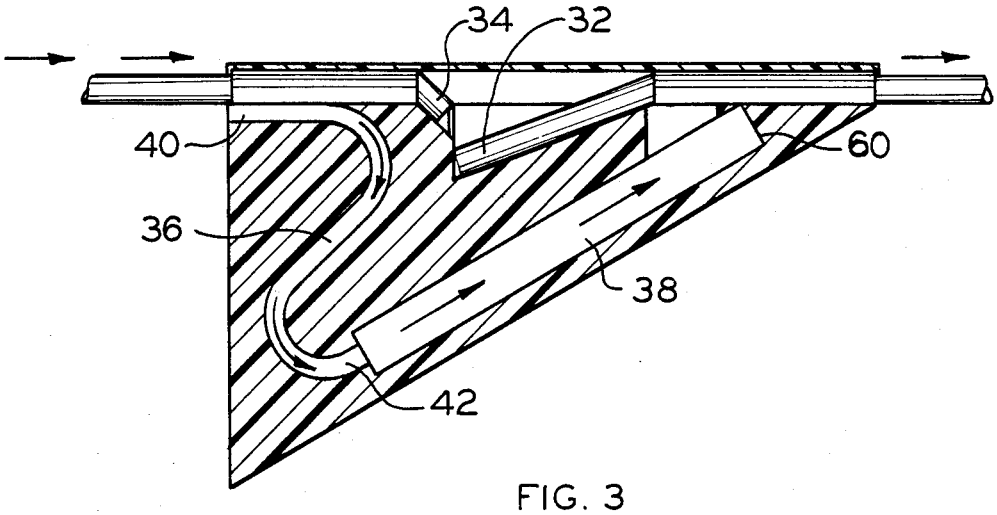
FIG. 3 is a longitudinal cross-section view of the preferred embodiment of the present invention in a closed position.

As projection 30 is pressed against detonating cord 14 towards razor blades 24 and relieved sections 22 and 20 the detonating cord 14 is severed by razor blade 24. As best seen in FIG. 3, after the housing sections 10 and 12 are secured, detonating cord 14 is now severed between the cord clips 16 and 18 to produce two individual lengths having severed ends 32 and 34. As urged by projection 30, severed end 32 is shown within relieved area 20 and severed end 34 is shown within relieved area 22. The housing construction and, in particular, razor blade 24 and the upper housing 10 including projection 30 cooperate to separate the relieved areas 20 and 22 so that if a blasting initiation signal is propagated along detonating cord 14 from either end, the signal as it reaches ends 32 or 34 will not be directly propagated and initiate a signal in the other end 34 or 32, respectively. This aspect of the present invention reduces the chances of instananeous initiation of the now separated sections of detonating cord 14.

In an alternate embodiment of the invention, the connector may contain no severing or cutting means, thereby necessitating that detonating cord ends 32 and 34 be prepared prior to insertion into clips 18 and 16, respectively.

Figure 2:
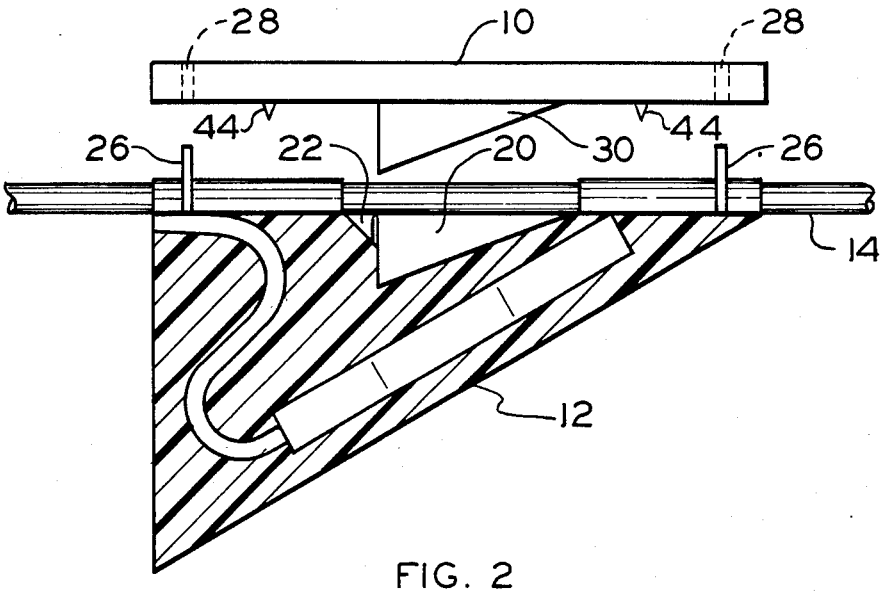
FIG. 2 is a longitudinal cross-section view of the embodiment of FIG. 1.

As seen in FIGS. 2 and 3, lower housing section 12 contains a signal delay assembly which includes linear signal transmission means, here shown as a signal transmission tube 36, and a delay explosive train 38. As used herein, the term "signal transmission tube" refers to any detonating or deflagrating signal transmission line comprising a flexible hollow tube which can carry a detonating or deflagrating signal along its interior, which signal does not destroy the tube. Such signal transmission tube may be any of the different available tubes, for example, "shock tube" having a detonating powder coated on the inner periphery of the tube, as disclosed in U.S. Pat. No. 3,590,739, transmission tube containing a combustible gas within the hollow tube, transmission tube containing a combustible substance carried on line inside the tube, or a transmission tube having a deflagrating substance coated on the inside of the tube as disclosed in co-pending U.S. patent application Ser. No. 811,731 assigned to the assignee of the present invention. The term "signal" when used in connection with the aforementioned transmission tube in intended to refer to both the detonating shock wave or deflagrating flame front which is transmitted along the interior of the shock tube by combustion of the reactive substances contained therein.

Other linear signal transmission means which may be used in place of a signal transmission tube include detonating fuse and detonating cord. An example of the latter is sold by The Ensign-Bickford Company under the trademark "Primaline". It is important that these other linear signal transmission means have a relatively low coreload so that combustion therein does not destroy the connector. However, the coreload should not be so low that the signal transmission means provides an unreliable connection between detonating cord end 34 and delay explosive train 38. Coreloads from about 2 to about 8 grains per foot are preferred.

A first end 40 of signal transmission tube 36 is positioned in signal receiving connection with detonating cord end 34. For greater reliability, this connection is made directly adjacent and below clip 16. In operation of the connector of the present invention, the detonating cord end 34 will receive the detonating signal from some detonating signal source and, when connected as shown in FIG. 3, will transmit that signal to transmission tube 36 at end 40. Transmission tube end 40 exposes the reactive interior transmission tube 36 so that when it is placed in close proximity to a combusting detonating cord, such as end 34, and enclosed by the housing, a signal will be initiated within end 40 of transmission tube 36. This signal will travel through transmission tube 36 to the opposite end 42 which is connected to a delay explosive train 38. It should be appreciated that the length of signal transmission tube 36 provides for a distal separation of detonating cord input end 34 from delay explosive train 38, thereby minimizing the probability of instantaneous ignition of delay explosive train 38 and detonating cord output end 32 as a result of a signal from detonating cord input end 34.

Figure 4:
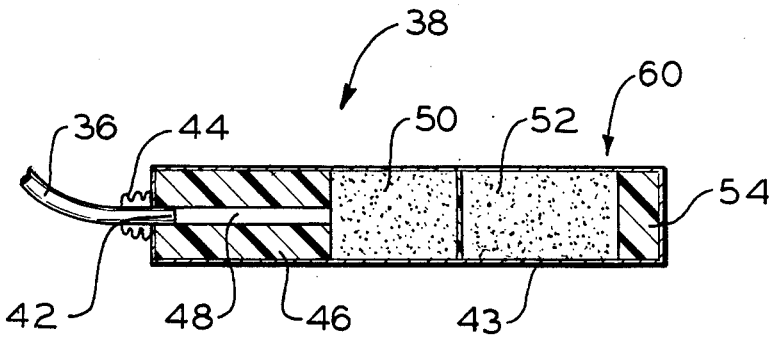
FIG. 4 is a longitudinal cross-section view of the delay assembly delay explosive train utilized in the preferred embodiment of the present invention.

The delay explosive train 38 is similar to that disclosed in U.S. Pat. Nos. 3,987,732 and 3,987,733. As best seen in FIG. 4, the explosive train 38 consists of a metal or plastic shell 43 that is closed at its ouput end 60 and is crimpably connected at its input end 44 to the second or output end 42 of signal transmission tube 36.

A bushing or adaptor 46 is positioned within shell 43 adjacent to input end 44 and houses delay element 48 along its central or axial cavity. As will be appreciated, a bushing of the type shown may not be required where the delay element 48 is of different size of shape. However, it is generally necessary to provide a bushing which will accept an end portion of the signal transmission tube 36 so as to provide a positive signal transmitting and propagating connection between the tube 36 and the delay element 48. The bushing can be constructed of any suitable plastic material such as polyolefins, rubber, ABS, nylon, vinyl or copolymers thereof, such as EVA. As shown, the signal transmitting tube 36 is positioned within the axial cavity of the bushing 46 and is retained therein by means of a crimp applied at the input end 44. The delay element 48 may be in the form of a pressed and shaped pyrotechnic charge or pellet within a lead or aluminum tube. The delay composition may vary depending upon the delay period required, but generally consists of mixtures of boron, tungsten, titanium, zirconium, silicon, molybdenum, barium chromate, lead oxide and alkaline metal nitrates, chlorates and perchlorates. The delay element 48 will provide a preselected signal delay time between the end adjacent to signal transmission tube end 42 and the delay element opposite end. Typical delay times which may be selected range from about 9 milliseconds to 10 seconds or more.

Immediately adjacent to delay element 48 is initiating or primary explosive charge 50 of a composition such as lead azide. Immediately adjacent to this initiating charge is a base charge 52. As will be appreciated, the initiating charge 50 need only be of sufficient size to assure ignition of the base charge 52 from the output of delay element 48. Other primary mixtures such as lead styphnate, DDNP, HNM, or mixtures thereof may be used in conjunction with or in place of the lead azide. The base charge 52 is near the output end 60 of the delay explosive train 38. This charge may any one of the conventional types commonly used in the explosive industry and can consist of organic nitrates, nitro compounds, organic or inorganic azides, including RDX, HMX, PETN, and similar explosive or mixtures thereof. These compounds may be aluminized or treated with antistatic agents, flow aids or similar additives. The purpose of base charge 52 is to ignite the output detonating cord end 32. Where the detonating cord end 32 is generally in a side-by-side relationship with the output end 60 of delay explosive train 38, as shown, as explosively inert filler layer 54 may be provided at output end 60 to promote the preferred side initiating function of the explosive train 38. The inert filler functions to minimize the end detonation effect of the base charge, thereby reducing the probability of mass detonating in a fire during shipping and minimizing a shrapnel effect off the end of the explosive train, possibly cutting the detonating cord end 32. This explosively inert material can be any one of a variety of materials, such as particulate or foam plastic, sugar, diatomaceous earth or similar material of a granular consistency.

The output end 60 of delay explosive train 38 is positioned for signal transmitting connection with the detonating cord end. As a blast initiating signal is transmitted through delay explosive train 38 and to output end 60, a signal will be initiated in output cord 32 by combustion thereof. The blasting initation signal will then travel along detonating cord section 32 away from the connector and toward a blasting charge (not shown).

While this invention has been described with reference to a specific embodiment, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

Having thus described the invention, what is claimed is:

1. A detonating cord signal delay connector comprising:

a housing;

means on said housing for engaging a first detonating cord end and for engaging a second detonating cord end;

barrier means on said housing to prevent detonating signal transmission directly between said first and second detonating cord ends.

a signal delay assembly in said housing for connection between said first detonating cord end and said second detonating cord end, said signal delay assembly being operable to delay a detonating signal between said first detonating cord end and said second detonating cord end;

said signal delay assembly including linear signal transmission means in said housing having a first end and a second end, said first transmission means end being adapted for signal receiving connection with said first detonating cord end;

a delay explosive train mounted in said housing with its signal input end being connected to said signal transmission means second end and its signal output end being adapted for signal transmission connection with said second detonating cord end, and gripping means for securing said detonating cord first and second ends in said housing to prevent removal of said ends.

2. The connector of claim 1 wherein said housing comprises first and second members operable between an open position permitting insertion of said detonating cord into said engaging means and a closed position permitting operation to delay a detonating signal between said detonating cord first and second ends.

3. The connector of claim 1 further including means on said housing for severing detonating cord to produce said detonating cord first and second ends.

4. The connector of claim 3 wherein said housing comprises first and second members operable between an open position permitting insertion of said detonating cord and a closed position permitting operation to delay a detonating signal between said detonating cord first and second ends, and wherein said severing means is operable to sever said detonating cord as said first and second housing members are closed.

5. The connector of claim 4 wherein one of said housing members contains a chamber, said severing means being mounted in said chamber, and wherein the other of said housing members contains a projection for urging said detonating cord against said severing means to produce said detonating cord first and second ends.

6. A detonating cord signal delay connector comprising:

a housing;

means on said housing for engaging at least one detonating cord;

means on said housing for severing engaged detonating cord to produce a first detonating cord end and a second detonating cord end;

a signal delay assembly in said housing for connection between said first detonating cord end and said second detonating cord end, said signal delay assembly including linear signal transmission means in said housing having a first end and a second end, said first transmission means end being adapted for signal receiving connection with said first detonating cord end; and a delay explosive train mounted in said housing and having a signal input end, a signal output end, and a preselected combustion time between said signal input and output ends, said signal input end being connected to said signal transmission means second end, said signal output end being adapted for connection with said second detonating cord end, said signal delay assembly being operable to delay a detonating signal between said detonating cord first and second ends; and gripping means for securing said detonating cord first and second ends in said housing to prevent removal of said ends before signal delay operation of said connector.

7. The connector of claim 6 including means on said housing to prevent detonating signal transmission directly between said first and second said detonating cord ends.

8. The connector of claim 6 wherein said linear signal transmission means comprises signal transmission tube.

9. The connector of claim 6 wherein said linear signal transmission means comprises low coreload detonating cord or fuse.

10. The connector of claim 6 wherein said housing comprises first and second members operable between an open position permitting insertion of said detonating cord into said engagement means and a closed position permitting operation to delay a detonating signal between said detonating cord first and second ends.

11. The connector of claim 10 wherein one of said housing sections contains a chamber, said severing means being mounted in said chamber, and wherein the other of said housing sections contains a projection for urging said detonating cord against said severing means to produce said detonating cord first and second ends.

12. The connector of claim 11 wherein said severing means is operable to sever said detonating cord as said first and second housing members are closed.

13. A detonating cord signal delay connector comprising:

a housing comprising first and second members operable between an open position and a closed position;

means on one of said housing members for receiving at least one detonating cord in said open position and engaging said detonating cord;

means on one of said housing members for severing engaged detonating cord to produce a first detonating cord end and a second detonating cord end after said housing members are in said closed position;

a signal delay assembly in one of said housing members for connection between said first detonating cord end and said second detonating cord end, said signal delay assembly including a signal transmission tube in said housing having a first end and a second end, said first transmission tube end being adapted for signal receiving connection with said first detonating cord end; and a delay explosive train mounted in said housing and having a signal input end, a signal output end, and a preselected combustion time between said signal input and output ends, said signal input end being connected to said signal transmission tube second end, said signal output end being adapted for connection with said second detonating cord end, said signal delay assembly being operable to delay a detonating signal between said detonating cord first and second ends after said housing members are in said closed position; and gripping means for securing said detonating cord first and second ends in said housing to prevent removal of said ends before signal delay operation of said connector.

14. The connector of claim 13 wherein one of said housing sections contains a chamber, said severing means being mounted in said chamber, and wherein the other of said housing sections contains a projection for urging said detonating cord against said severing means to produce said detonating cord first and second ends.

15. The connector of claim 14 wherein said severing means is operable to sever said detonating cord as said first and second housing members are closed.

16. The connector of claim 15 wherein said severing means and said housing projections cooperate to prevent detonating signal transmission directly between said first and second said detonating cord ends.

17. The connector of claim 16 wherein said signal delay assembly includes a delay element at said signal input end, said delay element being ignitable by a transmission tube signal and having said preselected combustion time, and an explosive charge at said signal output end, said explosive charge being ignitable by said delay element after said preselected combustion time and adapted for intiating a signal in said second detonating cord end.

* * * * *

UNITED STATES PATENT AND TRADEMARK OFFICE

CERTIFICATE OF CORRECTION

PATENT NO. : 4,716,831
DATED : January 5, 1988
INVENTOR(S) : Stephen W. Bartholomew, Daniel C. Rontey and William J. Necker It is certified that error appears in the above—identified patent and that said Letters Patent is hereby corrected as shown below:

Column 5, line 21, wherein the words "size of shape" should be --size or shape--.

Signed and Sealed this

Twenty-sixth Day of July, 1988

*Attest:*

DONALD J. QUIGG

*Attesting Officer*

*Commissioner of Patents and Trademarks*